US008256162B2

(12) United States Patent
Reithmeyer et al.

(10) Patent No.: US 8,256,162 B2
(45) Date of Patent: Sep. 4, 2012

(54) DOUBLE HUNG WINDOW WITH IMPROVED WATER MANAGEMENT SYSTEM

(75) Inventors: Joseph Guy Reithmeyer, Afton, MN (US); Ross McGruder, Saint Paul, MN (US); Wendy Polski, Cottage Grove, MN (US); Tim Kelley, Stillwater, MN (US)

(73) Assignee: Andersen Corporation, Bayport, MN (US)

( * ) Notice: Subject to any disclaimer, the term of this patent is extended or adjusted under 35 U.S.C. 154(b) by 528 days.

(21) Appl. No.: 12/372,094

(22) Filed: Feb. 17, 2009

(65) Prior Publication Data

US 2010/0205866 A1 Aug. 19, 2010

(51) Int. Cl.
*E06B 7/14* (2006.01)

(52) U.S. Cl. ..... 49/408; 49/476.1; 49/484.1

(58) Field of Classification Search ..... 49/61, 62, 49/63, 125, 408, 476.1, 484.1, 489.1
See application file for complete search history.

(56) References Cited

U.S. PATENT DOCUMENTS

| | | | | | |
|---|---|---|---|---|---|
| 2,608,277 | A | * | 8/1952 | Storms | 49/438 |
| 2,733,487 | A | * | 2/1956 | Hauck | 52/209 |
| 3,319,381 | A | * | 5/1967 | Muessel | 49/430 |
| 3,383,815 | A | | 5/1968 | Smith, Jr. | |
| 3,410,027 | A | * | 11/1968 | Bates | 49/471 |
| 3,466,819 | A | * | 9/1969 | Giger | 52/1 |
| 3,503,169 | A | * | 3/1970 | Maki et al. | 52/209 |
| 3,636,660 | A | * | 1/1972 | Peterson | 49/408 |
| 3,638,372 | A | * | 2/1972 | Rosenthal | 52/97 |
| 3,849,938 | A | * | 11/1974 | Thompson | 49/471 |
| 4,003,171 | A | * | 1/1977 | Mitchell | 52/209 |
| 4,553,361 | A | * | 11/1985 | Ralph | 52/209 |
| 4,586,291 | A | * | 5/1986 | Swan | 49/501 |
| 4,742,647 | A | * | 5/1988 | Pacca | 49/505 |
| 5,044,121 | A | * | 9/1991 | Harbom et al. | 49/401 |
| 5,121,951 | A | * | 6/1992 | Harbom et al. | 292/175 |
| 5,123,212 | A | * | 6/1992 | Dallaire et al. | 52/209 |
| 5,379,824 | A | * | 1/1995 | Carvalho | 160/90 |
| 5,787,659 | A | * | 8/1998 | Rinehart | 52/209 |
| 5,887,387 | A | * | 3/1999 | Dallaire | 49/408 |
| 6,243,999 | B1 | * | 6/2001 | Silverman | 52/204.51 |
| 6,276,099 | B1 | * | 8/2001 | O'Shea | 52/204.1 |
| 6,357,186 | B1 | * | 3/2002 | Gould | 52/209 |
| 6,374,557 | B1 | * | 4/2002 | O'Donnell | 52/209 |
| 6,679,002 | B2 | * | 1/2004 | Davies et al. | 49/360 |
| 2003/0177699 | A1 | * | 9/2003 | Fukuro et al. | 49/408 |
| 2005/0072076 | A1 | * | 4/2005 | Fulton et al. | 52/204.5 |

* cited by examiner

*Primary Examiner* — Katherine W Mitchell
*Assistant Examiner* — Justin Rephann
(74) *Attorney, Agent, or Firm* — Womble Carlyle Sandridge & Rice LLP

(57) ABSTRACT

A water management system for a double hung window prevents leakage between the lower sash and the frame of the window in a blowing rainstorm. The water management system comprises interior pressure-drop seals disposed between the vertical stiles of the lower sash and the jambs of the window frame and an interior pressure drop seal disposed along an interior edge of the bottom rail of the lower sash and the sill of the frame. Exterior shingling seals are disposed at least between outside edges of the sash and the jamb and the exterior shingling seals and the interior pressure-drop seals at least partially bound vertical channels. A vent communicates between the vertical channels and the outside environment to maintain the pressure in the vertical channels substantially the same as that of the outside environment. This prevents rainwater in a blowing rainstorm from violently breaching the exterior shingling seals and splashing onto the interior pressure-drop seals, which, in turn, prevents leaks into a home.

15 Claims, 5 Drawing Sheets

DOUBLE HUNG WINDOW WITH IMPROVED WATER MANAGEMENT SYSTEM

TECHNICAL FIELD

This disclosure relates generally to fenestration and more particularly to the management of rainwater leakage in double hung window units to prevent the interior pressure drop seals of such window units from becoming wet, which can result in leaks.

BACKGROUND

Sealing window units better against water leakage, particularly in driving rainstorm conditions, has long been a goal of window manufacturers. In fact, in order to earn the Hallmark certification of the Window and Door Manufacturers Association (WDMA) for water penetration resistance (and other certifications), a window must pass a rigorous test such as tests conducted under the ASTM E547-00 and ASTM E331-00 test methods. The test generally seeks to model a severe rainstorm with wind driven rain and may require a window to be exposed, for instance, to a pressure drop (based on 15% of required wind resistance design pressure) with water sprayed at a rate of 5 gallons per square foot per hour. This rate of water theoretically creates a film of water on all surfaces of the window to assure that the water bridges any breaches in the weatherstrip seals around the window sashes. If a leak through these seals occurs, water can be propelled through the breach due to the lower pressure on the interior side of the window, which results in a water penetration failure.

Double hung windows are especially hard to seal against water penetration in a driving rain because there are two parallel vertically sliding sashes in different planes. To accomplish a seal, horizontal compression seals generally are applied along the top rail of the upper sash and the bottom rail of the lower sash to seal against the header and sill respectively of the window. Single vertical sliding compression seals generally are applied between the interior edges of the stiles of the upper sash and the jambs, while single vertical sliding exterior compression seals generally are applied between the exterior edges of the stiles of the lower sash and the jambs. A horizontal compression checkrail seal resides between the check rails of the upper and lower sashes when the sashes are closed. Finally, a horizontal sliding seal bridges the upper and lower sash vertical sliding compression seals and the end of the checkrail seal. The complexity introduced by changes in plane and functionality of sliding sashes in double hung windows creates barriers to the success of developing a watertight single barrier seal. While the upper sash is often the easiest to seal successfully, it customarily is more difficult to create reliable seals at the transition from the upper sash seals to the lower sash seals and at the bottom corners of the lower sash seals. As a consequence, some leakage of water at these and perhaps other locations is inevitable, particularly in a blowing rainstorm.

Some window manufacturers have addressed water leakage past the seals of a double hung window by catching water that does leak in a reservoir. Many times, the reservoir is formed by an interior sill stop that projects upwardly from the sill along its interior edge and overlies some of the interior face of the lower sash bottom rail. The resulting reservoir will catch and contain a given volume of water. However, if the volume of water that leaks through the seals exceeds the volume of the reservoir, which can happen in prolonged storms, the reservoir can overflow the sill stop resulting in an unacceptable interior leak. Another technique is to catch water that has leaked through the seals in a reservoir and purposefully drain the water back out through a defined path such as a weep hole. This technique requires a reservoir with a water column height great enough to ensure that the water pressure in the reservoir overcomes the exterior pressure in a blowing rainstorm. Water is then able to flow back out to the higher pressure outdoor or exterior side of the window. This drains water from the reservoir and prevents water from overflowing into the interior of the building.

An improved water management system for double hung windows is needed and it is to the provision of such a system that the present disclosure is primarily directed.

SUMMARY

Briefly described, a double hung window with improved water management system includes a frame with jambs and a sill and upper and lower sashes slidably disposed in the frame with the lower sash residing in an interior plane relative to the upper sash. An interior pressure drop seal is disposed between each of the stiles of the lower sash and the jambs along the interior of the sash. A similar pressure drop seal extends along the bottom rail of the lower sash and, when the sash is closed, resides between the bottom rail and the sill along the interior of the lower sash. A generally U-shaped seal is thus formed around the interior of the bottom sash by the pressure drop seals.

To seal around the exterior of the lower sash, a shingling exterior seal is disposed between each of the stiles of the lower sash and the jambs along the exterior of the sash. Another shingling seal may be disposed between the bottom rail of the lower sash and the sill along the outside of the sash. Finally, a bridge seal is disposed at the tops of the stiles of the lower sash bridging and sealing the space between the interior pressure drop seals and the exterior shingling seals.

With the just described configuration, a generally U-shaped cavity or volume is defined between the lower sash and the window frame by the interior pressure drop seals and the shingling seals extending along the styles and the bottom rail of the lower sash and the bridge seal at the tops of the styles of the lower sash. A vent is provided to vent this U-shaped volume to the exterior of the building, i.e. to the outdoor environment. In one embodiment, the vent is defined by a vent channel in the window jambs at the bottom corners of the window frame and, in another, the bottom rail shingling seal is at least partially eliminated along the outside of the bottom rail of the lower sash to provide a vent space along the bottom rail itself. In either case, the vent assures that the pressure within U-shaped volume is maintained as close as possible to the pressure on the exterior side of the window. Thus, in a blowing rainstorm, where the pressure on the exterior of the window is higher than the pressure on the interior of the window, the pressure in the U-shaped volume stays close to the higher exterior pressure. Accordingly, water is less likely to seep past the exterior shingling seals and any water that does seep in is not likely to be propelled against the interior pressure drop seals, where it can be sucked by lower interior pressure into a building. Instead, the seepage simply flows in an orderly fashion down the sides of the U-shaped volume, where it drains to the exterior through the vent.

Thus, an improved water management system for double-hung windows is now provided. The water management system enhances a windows capacity to withstand blowing rainstorms without leakage of water into the interior of a dwelling. These and other aspects, features, and advantages of the invention will become more apparent upon review of the detailed description set forth below taken in conjunction with the accompanying drawing figures, which are briefly described as follows.

DETAILED DESCRIPTION

Figure 1:
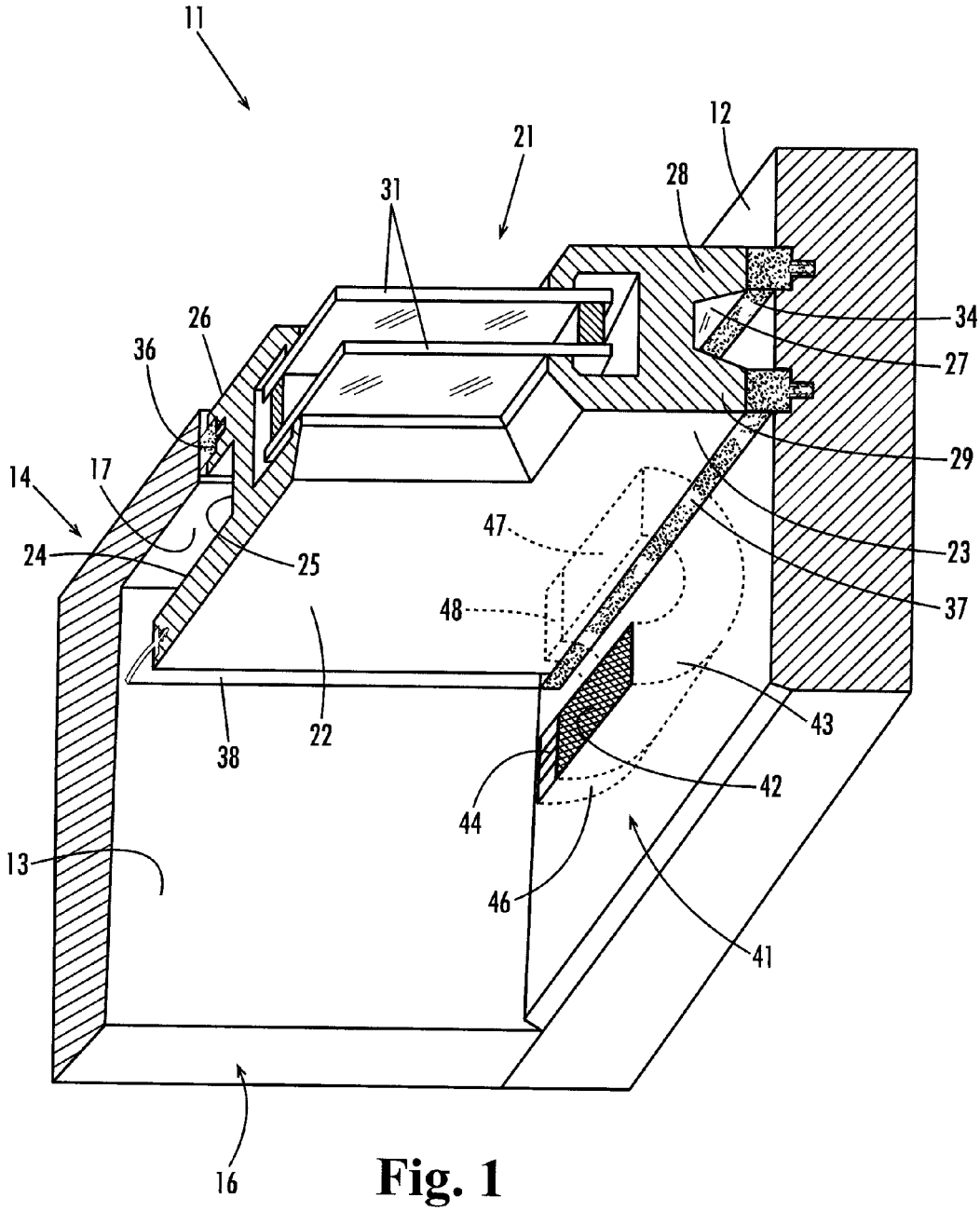
FIG. 1 is a perspective sectioned view of the right bottom exterior corner portion of a double-hung window unit illustrating one embodiment of the water management system.

Referring now in more detail to the drawing figures, wherein like reference numerals indicate like parts throughout the several views, FIG. 1 illustrates a portion of a double-hung window; namely, the bottom right corner portion of a double-hung window. The double-hung window 11 comprises a frame having pair of vertical jambs 12 (only the right jamb is visible in FIG. 1) and a sill 13 spanning the bottoms of the jambs 12. A head jamb (not visible) spans the tops of the vertical jambs 12. The sill 13 has an interior edge portion 14 and an exterior edge portion 16 and slopes generally downwardly from the interior edge portion to the exterior edge portion to shed water away from the window. The sill may be formed with an upstanding interior sill stop 17 along the interior edge portion 17, which forms a dam to prevent water on the sill from leaking into the interior of a building. It will be understood that the jamb 12 is illustrated in simplified form in the figures to aid in understanding of the invention. In reality, of course, a jamb liner generally will be mounted to the jamb to receive and providing sliding tracks for the sashes of the window.

The double-hung window includes a lower sash 21 that is vertically slidably disposed in the window frame and an upper sash (not shown) that also is vertically slidably disposed in the window frame. The upper sash is omitted in the drawings for the sake of clarity since the invention relates to a water management system for the lower sash. The lower sash 21 has a pair of vertical stiles 23 (only the right stile is shown in the Figures), a bottom rail 22, and a top or check rail 56 (FIG. 3), all of which form a sash frame. An integrated glass unit 31 is mounted in the sash frame in a traditional manner. The bottom rail 22 of the lower sash 21 is formed with an exterior leg 24 and an interior leg 26 that together form a horizontally extending channel 25 along the bottom rail 22. The stiles 23 are formed along their outside edges with an interior leg 28 and an exterior leg 29 that together define a vertically extending channel 27. The vertically extending channels 27 of the stiles intersect the horizontally extending channel 25 of the bottom rail 22 to form a generally U-shaped chamber or volume extending around the sides and bottom of the lower sash 21. Again, the shapes of the channels shown in the figures are simplified for clarity and may take on other and/or more complex configurations in an actual window.

An interior pressure-drop seal 34 is disposed between the jambs 12 and the interior leg 28 of the stiles 23 and is configured such that the lower sash 21 can slide vertically along the seal 34. A horizontal pressure-drop seal 36 is disposed along the interior leg 26 of the bottom rail 22 and is configured to form a seal between the interior leg 26 and the top of the interior sill stop 17 when the bottom sash is closed. Thus, the vertical pressure drop seals 34 and the horizontal pressure drop seal 36 form a generally U-shaped seal around the interior of the bottom sash. These seals can be separate items, or they can be formed by one continuous U-shaped seal extending around the sides and bottom of the sash.

Figure 3:
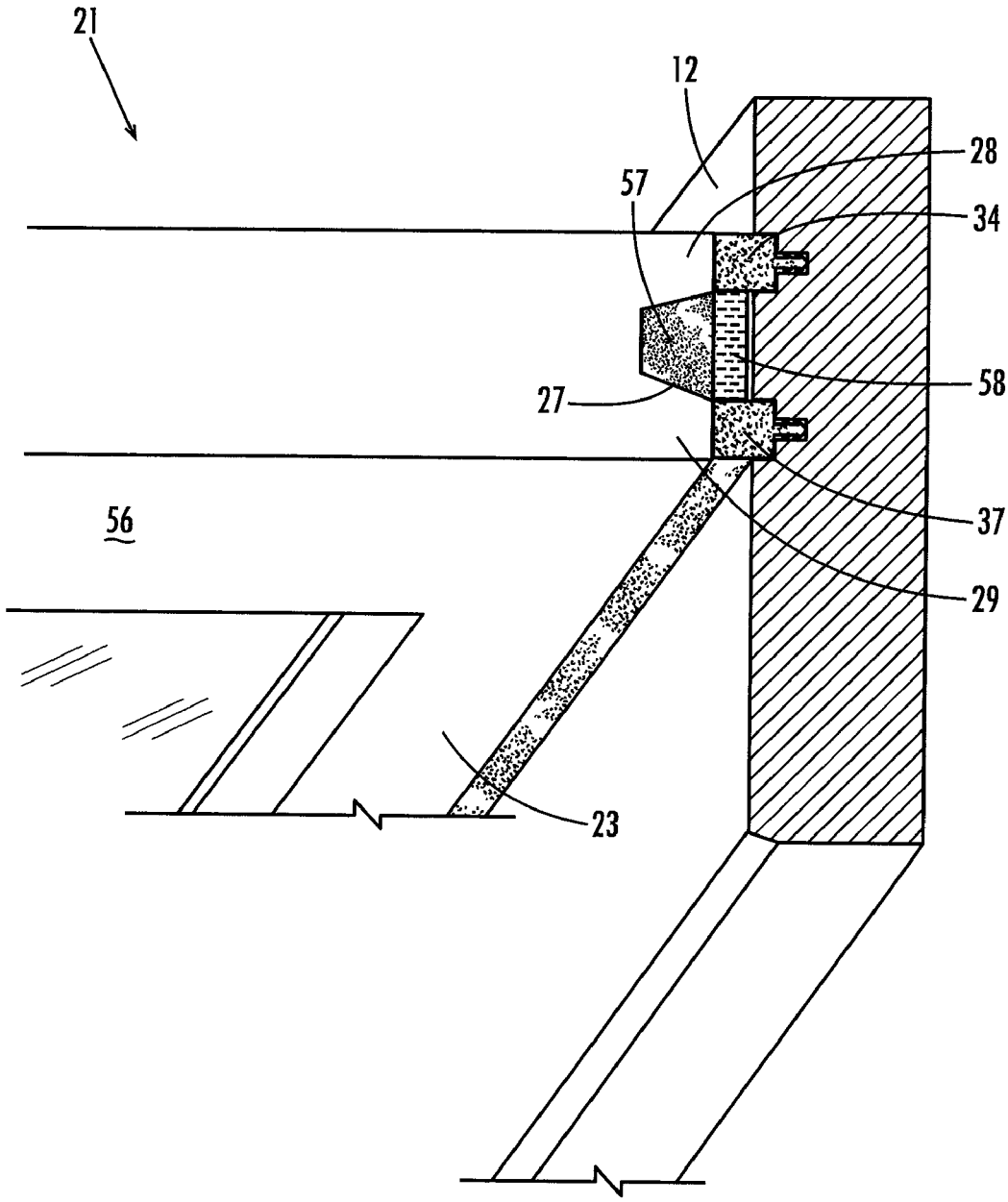
FIG. 3 is a perspective sectioned view of the top right corner of the lower sash of a double-hung window unit illustrating one embodiment of a bridging seal.

Exterior shingling seals 37 (only one of which is visible in the figures) are disposed between the exterior legs 29 of the stiles 23 and the jambs 12 (or jamb liners as the case may be). These exterior shingling seals and the interior pressure drop seals function to seal the outside and inside edges of the stiles and seal the channel 27 therealong. In the embodiment of FIG. 1, a horizontal shingling seal 38 is attached to the bottom of the exterior leg 24 of the bottom rail 22 and, when the sash 21 is closed, forms a seal between the exterior leg 22 and the sill 13. It will thus be seen that the interior pressure-drop seals 34 and 36 and the exterior shingling seals 37 and 38 define a substantially sealed U-shaped channel comprising vertical channels 27 along the stiles and horizontal channel 25 along the bottom rail 22. This U-shaped channel is sealed at the top of the lower sash. More specifically, FIG. 3 shows the top right corner portion of the lower sash with horizontal check rail 56 and vertical stile 23. A plug 57 is disposed in the upper end of the vertical channel 27 at the top of stile 23 to seal the top of the channel. A flexible fin seal 58 forms a seal bridge between the interior pressure-drop seal 34 and the exterior shingling seal 37. Thus, in the illustrated embodiment, the lower sash 21 is free to slide up and down within the window frame while the vertical channels 27 remain sealed along their inside edges, their outside edges, and their top ends. If the fin seal 58 is attached to the jamb, which is within the scope of this disclosure, the vertical channels 27 are sealed at the top only when the sash is in the closed position.

The interior pressure drop seals and the exterior shingling seals and perhaps other seals can be any appropriate type of weatherstrip seal such as, for instance, a urethane foam seal with polyethylene cladding such as is available from the Schlagel company or a TPV foam coated with TPV cladding as is available from the Foam-Tite company. In general, any weatherstrip with a slip coat and low compression set is preferable and may be employed as the interior and exterior seals. Further, in the illustrated embodiment, the interior and exterior seals are fixed to the jamb; however, they also may be fixed to the stiles of the sashes if desired.

Referring again to FIG. 1, a vent and drain structure 41 is formed at the lower end of one or both of the jambs 12 for venting the channels 25 and 27 to the outdoors. In the illustrated embodiment, the vent and drain structure 41 comprises a vent channel 43 that opens at one end 47 within the channel 27 between the stile 23 and the jamb 12 and at its other end on the exterior side of the lower sash 22. Below the vent channel 43 is a drain channel 46 that also communicates between the bottom of the channel 27 (or the right end of the channel 25) and the outdoors adjacent the sill 13. Accordingly, when the lower sash 22 is closed, the resulting U-shaped channel around the sides and bottom of the lower sash are vented to the outdoors and provided with a drain at their bottom corners. The drain channel 46 and vent channel 43 may be separate channels or the drain channel may simply be the lowermost portion of the vent channel, and may be configured in various shapes.

The water management system shown in FIG. 1 functions as follows to prevent leakage in severe weather conditions such as a blowing rainstorm. As wind and wind driven rain impinge upon the window, virtually all surfaces on the exterior side of the window, and particularly the lower sash, become coated with a layer or sheet of water. Further, the wind creates a pressure differential between the exterior of the window and the interior of the window within the home such that the pressure on the inside of the window is lower than the pressure on the outside of the window. If the U-shaped channel 25, 27 was open to the interior of the home (as can be the case in the prior art) and thus maintained at the lower interior pressure, this would tend to suck water past the exterior shingling seals propel it with sufficient force that the water would splash against the interior pressure-drop seals 34, 36. Ultimately, with the aid of the pressure differential, the water on the interior pressure-drop seals can breach those seals and cause an unacceptable interior leak. However, with the water management system of the embodiment shown in FIG. 1, the channel is not open to the interior of the building but instead is sealed to the interior and vented to the outside through vent and drain structure 41. Thus the pressure within the U-shaped channel 25, 27 is maintained not at the lower interior pressure, but at the higher exterior pressure. As a result, the exterior shingling seals 37, 38 tend to knock the energy out of and shed most of the water that may collect along these seals. Further, because the pressure in the channel is at or near the exterior pressure, water does not tend to be sucked past the exterior shingling seals and thus does not tend to be propelled across the gap to the interior pressure-drop seals. The pressure-drop seals thus remain dry and no water seeps past them to the inside of the home. Any small volume of water that does overcome or penetrate the exterior shingling seals flows orderly and harmlessly down the exterior side of the channels 27 to the sill, from where it is drained to the exterior of the sash through drain channel 46.

As the outside pressure rises due to wind, an airflow can be created through the vent channel 43 into the channel 27 due to the likelihood that the primary seal is not perfect and some air will leak through, the primary seal causing an air flow to exist through vent channel 43 into channel 27. The vents are sized sufficiently to keep air flow velocity through the channel 27 relatively low. This is important because, if the vent channel is too small, the velocity of air flowing through the vent channel can be high, and can carry water droplets with it into the channel 27 and splash the water onto the interior pressure drop seal, which can easily result in an interior leak. With an appropriately sized vent channel, the velocity of air flowing through the channel is kept relatively low and the volume of air within the channel 27 is kept close to the exterior air pressure. Thus, water droplets do not get carried to the interior pressure-drop seals and interior leaks are prevented. Another consideration is that the vent channel should be kept large enough that water cannot span the vent channel due to surface tension and capillary action, which can turn the vent into a straw, drawing water directly into the channel 27, 25. The drain channel 46 should be sufficiently sized to allow any water that overcomes or penetrates the exterior shingling seals to drain out through the drain channel.

Figure 2:
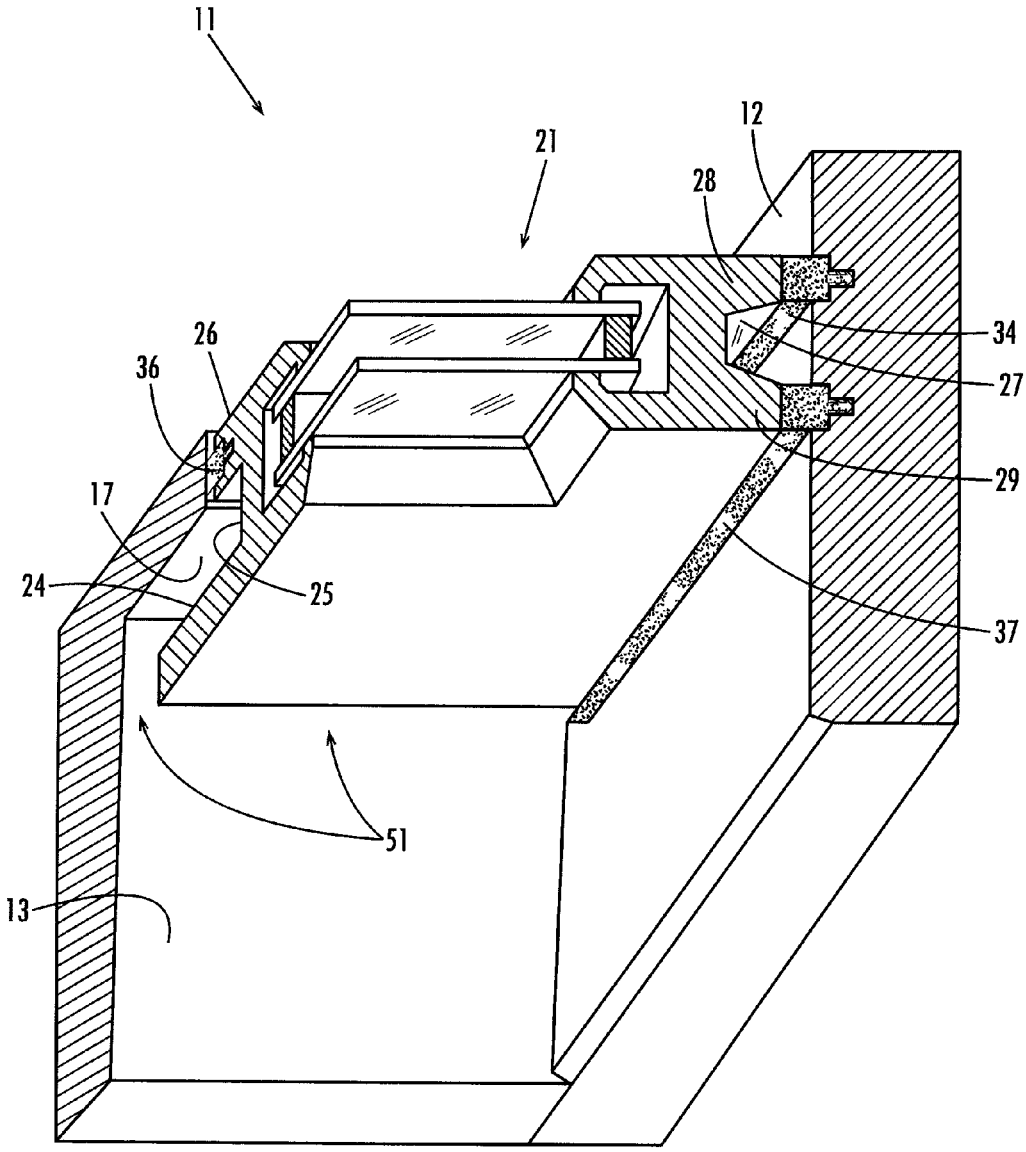
FIG. 2 is a perspective sectioned view of the right bottom exterior corner portion of a double-hung window unit illustrating an alternate embodiment of the water management system.

FIG. 2 illustrates an alternate embodiment of the water management system according to the present invention. All of the illustrated elements in the embodiment of FIG. 2 are the same as in the embodiment of FIG. 1 except that there is no exterior shingling seal along the bottom rail of the sash 21. Instead, the exterior leg 24 of the bottom rail terminates above the surface of the sill 13 to define a horizontal gap 51. The gap 51 in the embodiment of FIG. 2 serves the function of the vent and drain structure 41 in the embodiment of FIG. 1. More specifically, the gap 51 allows air to flow into the U-shaped volume or channel 25, 27 to maintain the pressure within this channel near a higher outside pressure rather than a lower inside pressure. This keeps the interior pressure-drop seals 34, 36 dry and prevents interior leaks as discussed above. Any water that does breach or penetrate the exterior shingling seals 37 flows orderly down the channel 27 to the sill 13, from where it simply flows through the horizontal gap 51, down the sill 13, and is shed. The sill slope and clear vertical distance between the bottom edge of the exterior leg 24 and the top surface of the sill are important. The sill slope and clear vertical distance need to be configured and sized such that a film of water collecting on the sill does not build up to a depth that can bridge the gap 51. It is preferred that there is additional space beyond this bridging space to provide venting along the entire length of the bottom rail and to ensure that there is no bridging of water.

Figure 4:
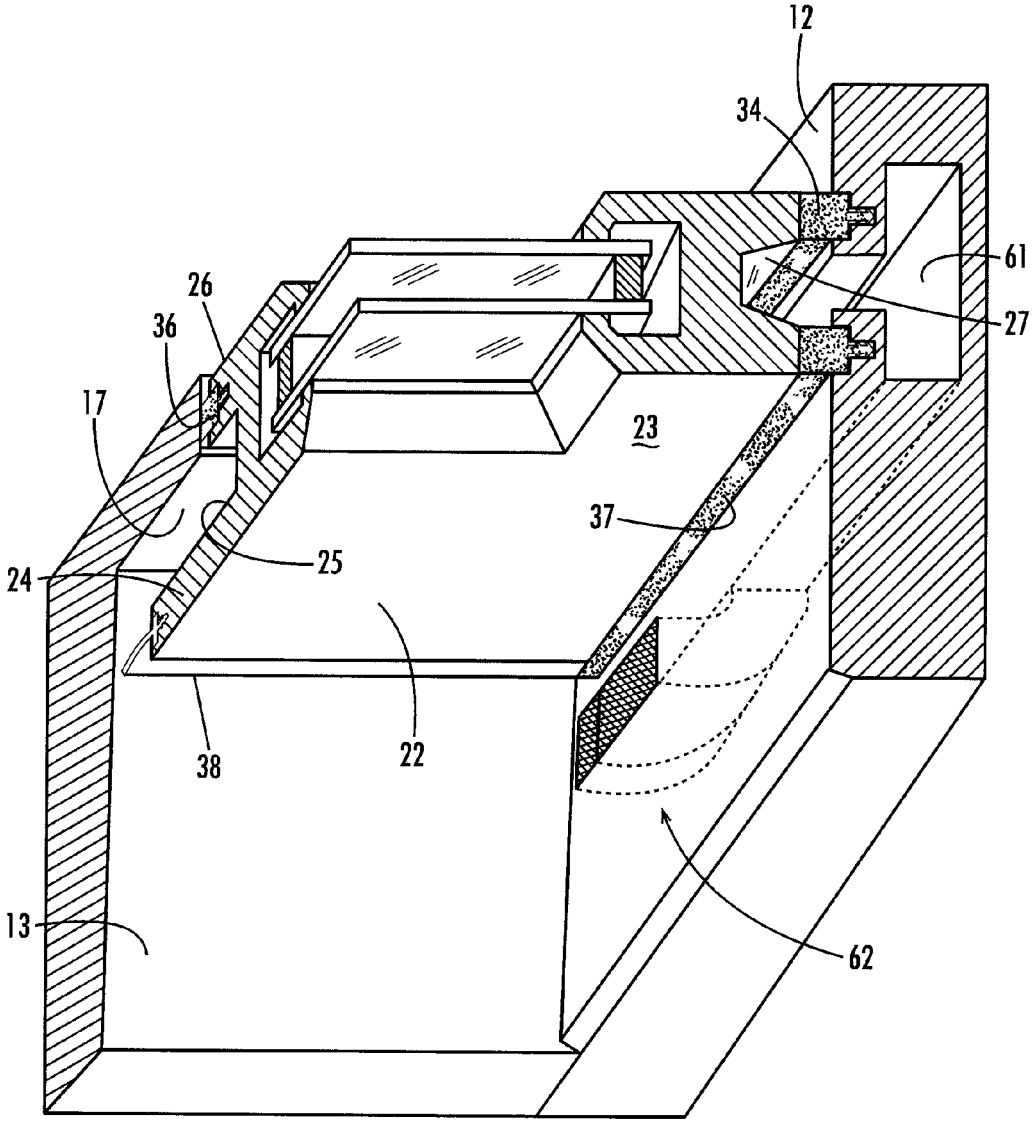
FIG. 4 is a perspective sectioned view of the right bottom exterior corner portion of a double-hung window unit illustrating one another alternate embodiment of the water management system.
Figure 5:
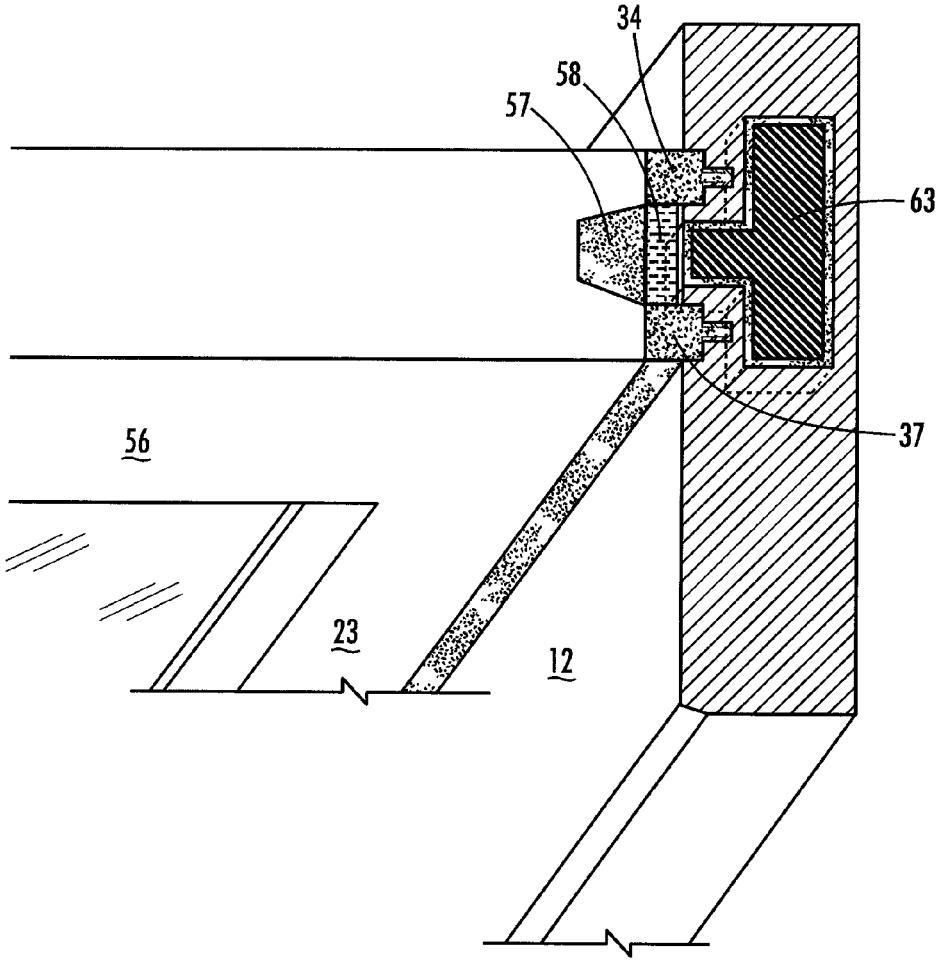
FIG. 5 is a perspective sectioned view of the top right corner area of the lower sash of a double-hung window unit illustrating a transition plug for use with the alternate embodiment of FIG. 4.

Another embodiment of the invention is illustrated in FIGS. 4 and 5. This embodiment is similar in many respects to that of FIG. 1, and particularly in that it includes an exterior shingling seal 38 along the bottom rail of the lower sash. In this embodiment, however, a counterbalance cavity 61 is formed in each vertical jamb 12 communicating with the channels 27 and expanding the total effective volume thereof. The counterbalance cavity is sealed at the location of the transition between the upper and lower sash with a transition plug 63 as illustrated in FIG. 5. The transition plug 63, plug 57, and fin seal 58 insure that the entire volume of the combined channel 27 and counterbalance cavity 61 is sealed and not open to the interior of a home. This transition plug also provides support for the sash counterbalances, seals the perimeter of the balance cavity, and extends the seal to the horizontal bridge transition seal 58. As in the embodiment of FIG. 1, the counterbalance cavity 61 and thus the channel 25, 27 are vented to the outdoors through a vent 62 formed in one or both of the vertical jambs 12, each vent 62 having a drain at is bottom as in FIG. 1. Pressure within the counterbalance cavity 61 and the channel 25, 27 is thus maintained near outside pressure as described in detail with respect to the embodiment of FIG. 1. Inclusion of the expanded volume of air provided by the counterbalance cavity 61 increases the volume of the buffering chamber behind the exterior shingling seals, making the system more robust. Of course, the addition of volume may be provided through a cavity other than a counterbalance cavity. Also, this embodiment is equally applicable to venting through a horizontal gap at the bottom of the lower sash (FIG. 2) rather than the illustrated vent structure.

The invention has been described within the context of preferred embodiments and methodologies considered by the inventors to represent the best mode of carrying out the invention. However, a wide variety of additions, deletions, and modifications to the illustrated embodiments might be made by those of skill in the art without departing from the spirit and scope of the invention as set forth in the claims. For example, while venting through the side jambs has been illustrated, the vent may be formed through the sill, or through any other part of the window frame or through the sashes so long as the channel between the exterior and interior seals is vented to the outside atmosphere.

What is claimed is:

1. A window comprising:

a frame having vertical jambs and a sill;

a sash having vertical stiles with interior and exterior edges, a bottom rail with interior and exterior edges, and a check rail, the sash being slidable within the frame between a closed position wherein the bottom rail resides adjacent the sill, and an open position, each vertical style being disposed adjacent a respective vertical jamb;

first interior seals disposed along the interior edges of the vertical stiles and configured to seal between the vertical stiles and the jambs;

a second interior seal disposed along the interior edge of the bottom rail and configured to seal between the bottom rail of the sash and the sill;

first exterior seals disposed along the exterior edges of the vertical stiles and configured to seal between the stiles and the jambs, the first interior seals and the first exterior seals of respective vertical stiles at least partially defining respective vertical channels between each of the vertical styles and the adjacent jamb; and a vent communicating between the vertical channels and the environment outside the window to maintain the pressure within the vertical channels substantially the same as the outside pressure.

2. A window as claimed in claim 1 and wherein the vent is formed in at least one of the jambs.

3. A window as claimed in claim 2 and wherein the vent has one opening within the vertical channels and another opening exposed to the outdoor environment.

4. A window as claimed in claim 1 and wherein the vertical channels communicate with a horizontal channel formed along the bottom rail to define a generally U-shaped volume and further comprising a second exterior seal disposed along the exterior edge of the bottom rail, the second interior seal and the second exterior seal being configured to seal the horizontal channel.

5. A window as claimed in claim 4 and wherein the vent is formed in at least one of the jambs.

6. A window as claimed in claim 1 and further comprising a cavity formed in each of said jambs and communicating with the channel between the first interior and first exterior seals of the stiles.

7. A window as claimed in claim 6 and wherein the cavity is a counterbalance cavity.

8. A window as claimed in claim 7 and further comprising a transition plug at a predetermined location along the counterbalance cavity.

9. A window as claimed in claim 1 and wherein the vertical channels are sealed at respective upper ends.

10. A window as claimed in claim 9 and wherein the channels are sealed at least partially with a fin seal bridging the interior and exterior seals.

11. A window comprising:

a frame having spaced vertical jambs;

a sash disposed in the frame, the sash having spaced vertical stiles each disposed adjacent to a respective vertical jamb, each vertical stile having an interior edge and an exterior edge;

spaced apart seals disposed between each of the vertical stiles of the sash and the frame adjacent a vertical jamb of the frame, one seal extending along the exterior edge of each vertical stile and another seal extending along the interior edge of each vertical stiles, the spaced apart seals at least partially defining respective channels between the vertical stiles and the adjacent vertical jambs; and at least one vent communicating with the channels and with an outside environment.

12. The window of claim 11 and wherein the sash is slidable within the frame.

13. The window of claim 11 and further comprising at least one seal disposed between a horizontal bottom rail of the sash and a sill of the frame.

14. The window of claim 13 and further comprising spaced apart seals disposed between the horizontal bottom rail of the sash and the sill of the frame and at least partially bounding a horizontal channel between the horizontal bottom rail and the sill.

15. The window of claim 14 and wherein the vertical channels and the horizontal channel communicate to form a generally U-shaped volume around the vertical stiles and the bottom rail of the sash.

* * * * *

UNITED STATES PATENT AND TRADEMARK OFFICE
Certificate

Patent No. 8,256,162 B2

Patented: September 4, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Joseph Guy Reithmeyer, Afton, MN (US); Ross McGruder, Saint Paul, MN (US); Wendy Polski, Cottage Grove, MN (US); Tim Kelley, Stillwater, MN (US); and Thomas Coach, Osceola, WI (US).

Signed and Sealed this Third Day of June 2014.

KATHERINE MITCHELL
*Supervisory Patent Examiner*
Art Unit 3634
Technology Center 3600